US006282744B1

(12) United States Patent
Wieloch et al.

(10) Patent No.: US 6,282,744 B1
(45) Date of Patent: Sep. 4, 2001

(54) ELECTROSTATOGRAPHIC IMAGING WEB CLEANING SYSTEMS

(75) Inventors: Francis J. Wieloch, Penfield; Carl A. Wisniewski, Rochester; Warren R. Smith; Thomas B. Glenwright, both of Webster, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/640,417

(22) Filed: Aug. 17, 2000

Related U.S. Application Data

(62) Division of application No. 09/173,836, filed on Oct. 16, 1998, now Pat. No. 6,162,303, which is a division of application No. 08/652,721, filed on May 30, 1996, now Pat. No. 5,855,037.

(51) Int. Cl.[7] ..... B08B 6/00
(52) U.S. Cl. ..... 15/256.5; 15/3; 15/102
(58) Field of Search ..... 15/3, 100, 102, 15/256.5

(56) References Cited

U.S. PATENT DOCUMENTS 4,009,047 * 2/1977 Lindsay .
4,704,803 * 11/1987 Valentini .
4,982,469 * 1/1991 Nishiwaki .
5,251,348 * 10/1993 Corrado et al. .
5,275,104 * 1/1994 Corrado et al. .
5,425,813 * 6/1995 Ernst .

FOREIGN PATENT DOCUMENTS

0214741 * 3/1987 (EP) .
1590 * 1/1892 (GB) .

* cited by examiner

*Primary Examiner*—Randall E. Chin

(57) ABSTRACT

A contact cleaner roll cleaning system including a frame to support the system relative to a movable web having a first major surface and a second major surface on opposite sides of the web, at least a first rotatable contact cleaner roll supported on the frame disposed for rolling contact with the first major surface, an activatable web transporting device adapted to transport or interrupt the transport of the web past the first rotatable contact cleaner roll, and a first indexing device adapted to roll the first rotatable contact cleaner roll against the first major surface in a first direction while the transport of the web past the first rotatable contact cleaner roll is interrupted. This system is used to clean coated and uncoated webs.

6 Claims, 7 Drawing Sheets

ELECTROSTATOGRAPHIC IMAGING WEB CLEANING SYSTEMS

This application is a divisional of application Ser. No. 09/173,836, filed Oct. 16, 1998, now U.S. Pat. No. 6,162,303 which is a divisional of application Ser. No. 08/652,721, filed May 30, 1996, now U.S. Pat. No. 5,855,037.

BACKGROUND OF THE INVENTION

This invention relates in general to electrostatographic imaging web systems and more specifically, to an apparatus and process for cleaning electrostatographic imaging webs.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

The electrophotographic plate may be in the form of a flexible belt. Flexible electrophotographic belts are usually multilayered photoreceptors that comprise a substrate, a conductive layer, an optional hole blocking layer, an optional adhesive layer, a charge generating layer, and a charge transport layer and, in some embodiments, an anti-curl backing layer.

Although excellent toner images may be obtained with multilayered belt photoreceptors, it has been found that as more advanced, higher speed electrophotographic copiers, duplicators and printers were developed, the electrical and mechanical performance requirements have become more demanding. It has also been found that these electrical and mechanical performance requirements are not being met because of defects in one or more of the coated layers of the multilayered belt photoreceptors. These defects are caused by the presence of dirt particles on the substrate, conductive layer, optional hole blocking layer, optional adhesive layer, charge generating layer, charge transport layer and/or optional anti-curl backing layer. Thus for example, particles of dirt (particulate debris) residing on an uncoated or coated substrate surface during application of coatings to form an electrostatographic imaging member, such as a photoreceptor, can cause bubbles or voids to form in the various applied coating layers. It is believed that the dirt particles behave in a manner similar to a boiling chip which initiates solvent boiling at the location of the particle. This local boiling problem is aggravated when a coating solution is maintained near the boiling point of the coating solvent during deposition of the coating or during drying. The formation of bubbles in a coating is particularly acute in photoreceptor charge generation layer coatings and in charge transport layer coatings. Also, dirt particles tend to trap air during application of a coating and the trapped air expands during drying to form an undesirable bubble in the coating.

Further, any dirt particles residing on one or both major surfaces of an electrophotographic imaging member web substrate can adversely affect adjacent surfaces when the web is rolled up into a roll because the dirt particles cause impressions on the adjacent web surfaces. Because these undesirable impressions can be repeated through more than one overlapping web layer, large sections of a coated web must be scrapped. Where large belts, e.g. ten pitch belts, are to be fabricated, a 10 percent defect rate can result in the discarding of 20 to 30 percent of the entire web because very large expanses of defect free surfaces are required for such large belts.

The sources of the dirt particles include transporting systems, coating systems, drying systems, cooling slitting systems, winding systems, unwinding systems, debris from the electrophotographic imaging member web substrate itself, workers, and the like.

In relatively thin charge blocking layers, such as organopolysiloxane layers applied with a gravure coater, any dirt particles present on the web surface tends to lift the coating layer and cause local coating voids. This also occurs with relatively thin adhesive layers between a charge blocking layer and a charge generation layer. Usually, after a web substrate is coated with the charge blocking layer and adhesive layer, the coated web substrate is rolled up into a roll and transported to another coating station. During unrolling or unwinding of the coated web, static electricity is generated as the outermost ply of the coated web is separated from the roll. This static electricity tends to attract dirt particles to the exposed surfaces of the web.

It has been found that brushing, buffing or other cleaning systems which physically contact the delicate and fragile surfaces of a coated or uncoated electrophotographic imaging member web substrate can cause undesirable scratches in the delicate outer surface of the substrate even if the contact systems are employed in conjunction with electrostatic discharge bars. Cleaning systems that do not contact the coated or uncoated electrophotographic imaging member web substrate, such as air knives and vacuum systems, whether or not assisted with electrostatic discharge bars, are not capable of removing small particles, those having an average particle size of less than about 100 micrometers to less than about 0.5 micrometer range due to electrostatic attraction and a thin protective inertial air boundary layer on the substrate surface.

The use of a contact cleaner roll making continuous rolling contact with a moving web can remove loose particles of contamination from the web. As the web moves over the cleaner roll, the loose particulate matter is transferred from the web to the cleaner roll which is somewhat adhesive or tacky. As this transfer process continues, the transferred contaminants accumulate on the surface of the cleaner roll. The cleaner roll itself becomes contaminated and is replaced or cleaned periodically to restore its effectiveness. This is typically done by shutting down the system or process, retracting the cleaner roll, and washing and drying it manually. To avoid down time of the system or process, these contact cleaner rolls can be cleaned without interrupting the continuous movement of web through the apparatus by a device for sequential cleaning of the contact cleaner rolls. This type of contact cleaner roll system is disclosed, for example, in U.S. Pat. No. 5,251,348, the disclosure thereof being incorporated herein in its entirety.

INFORMATION DISCLOSURE STATEMENT

U.S. Pat. No. 5,251,348 to Corrado et al, issued Oct. 12, 1993—A contact cleaner roll cleaning system is described which includes a frame supporting the system relative to a moving web, a contact cleaner roll turret on the frame, and a roll cleaner on the frame. The turret supports two or more rotatable contact cleaner rolls, an active roll in rolling contact with the web, and an idle roll out of contact with the web for cleaning. The idle roll is kept rotating while it I's idle and being cleaned. The turret is rotatable to sequentially put the cleaner rolls into and out of contact with the web. The roll cleaner includes an absorbent cleaning material mounted adjacent to the idle roll for placement against it and movement lengthwise along it to wipe it clean. Spindles advance the cleaning material between wipings of the idle roll, and a liquid delivery system keeps the cleaning material wet.

U.S. Pat. No. 5,275,104 to Corrado et al, issued Jan. 4, 1994 Apparatus is disclosed for cleaning a rotating process roll includes cleaning material supply and take-up rolls and a compliant touch roll, all mounted on a carriage adjacent to a process roll. Touch roll and cleaning material are movable by air cylinders into and out of contact with the process roll. The touch roll is rotatable in one direction only with the take-up roll. A drive motor winds the take-up roll to incrementally and uniformly advance the cleaning material over the touch roll. Period and frequency of the cleaning cycle and sub-cycles are variable by microprocessor control. Supply roll and take-up roll are supported in retractable gudgeons for easy mounting and removal.

In pending application Ser. No. 08/505,931, entitled SYSTEM FOR CLEANING ELECTROSTATOGRAPHIC IMAGING WEBS, filed Jul. 24, 1995, now abandoned, in the names of G. M. LaManna et al., a contact cleaner roll cleaning system is disclosed which includes a frame to support the system relative to a moving web having a first major surface and a second major surface, a first rotatable contact cleaner roll supported on the frame disposed for rolling contact with the first major surface of the web, a second rotatable contact cleaner roll supported on the frame disposed for rolling contact with the second major surface of the web, the second rotatable contact cleaner roll having an axis parallel to the axis of the first rotatable contact cleaner roll, the first contact cleaner roll and the second contact cleaner roll being positioned on the frame to support and guide the moving web in a substantially "S" shaped path. This cleaning system provides excellent cleaning performance for the surface of webs. However, it has been found that if the cleaning system is employed in a web coating line which is stopped during operation so that the cleaner roll remains in stationary contact with the web for an extended length of time, such as for fifteen or more minutes, adhesion between the cleaner roll surface and the surface of the web can increase to a point where it becomes difficult to separate the the cleaning roll surface from the web surface. Start up of a coating line after stoppage can require manual separation of the web and cleaning rolls by the operator. Such manual separation is time consuming and can expose the operator to possible injury. Notwithstanding efforts to carefully peel the coated web from the cleaning roll, the coating on the web may still peel away from the web substrate and adhere to the roll. Thus, after the web cleaning system has remained stopped and the cleaner roll is allowed to remain in stationary contact with a coating on the web for an extended length of time, the adhesion of the cleaning rolls to the coating on the web substrate can cause delamination upon restarting the web coating line. The adhesion can be so great that the cleaning roll peels the coating away from the web substrate. Uncoated webs produce similar increases in adhesion with cleaning rolls, whereby the cleaning roll surface may separate cohesively from the roll body. Also, upon startup of the web coating line, adhesion of the cleaning rolls to the coated or uncoated web can cause wrinkling or stretching of the web, or cause the web to tear, or even prevent restarting of web transport. Stoppage of the web running line can occur for various reasons such as for repairing or adjusting mechanical or electronic problems that arise during the process, correcting a quality control problem, any decision to stop the production line, or process shutdown (e.g. overnight, weekends or holidays), for electrical power loss and the like. The disclosure of pending application Ser. No. 08/505,931, now abandoned, is incorporated herein in its entirety.

Thus, there is a need for a system to produce high quality electrostatographic imaging webs in higher yields by effectively removing dirt particles without damage to one or more coatings on a web substrate.

SUMMARY OF THE INVENTION

It is, therefore, an object of the present invention to provide an improved web cleaning system which overcomes the above-noted deficiencies.

It is another object of the present invention to provide an improved web cleaning system which avoids peeling or delamination of coatings from a web substrate after a web coating line has been stopped.

It is still another object of the present invention to provide an improved web cleaning system which produces an improved coated web.

It is yet another object of the present invention to provide an improved web cleaning system which removes dirt particles having a very small average particle size from both major surfaces of a coated web.

It is yet another object of the present invention to provide an improved cleaning system that that can be rapidly started after stoppage.

It is still another object of the present invention to provide an improved web cleaning system which can be automatic.

The foregoing objects and others are accomplished in accordance with this invention by providing a contact cleaner roll cleaning system which includes a frame to support the system relative to a movable web having a first major surface and a second major surface on the opposite sides of the web. The web comprising-a-coated or uncoated major surface, at least a first rotatable contact cleaner roll supported on the frame disposed for rolling contact with the first major surface, an activatable web transporting device adapted to transport or interrupt the transport of the web past the first rotatable contact cleaner roll, and a first indexing device adapted to roll the first rotatable contact cleaner roll against the first major surface in a first direction and to roll the first rotatable contact cleaner roll against the major surface in the same or opposite direction while the transport of the web past the first rotatable contact cleaner roll is interrupted.

This system may be employed in a process for cleaning a web having a first major surface and a second major surface on opposite sides of the web, the process comprising transporting the web while maintaining at least a first contact cleaning roll in rolling contact with the first major surface, interrupting the transporting of the web, rolling the first rotatable contact cleaner roll against the first major surface in at least a first direction, and rolling the first rotatable contact cleaner roll against the first major surface in the same or opposite direction while the transport of the web past the first rotatable contact cleaner roll is interrupted.

BRIEF DESCRIPTION OF THE DRAWINGS

A more complete understanding of the process of the present invention can be obtained by reference to the accompanying drawings wherein.

The figures are merely schematic illustrations of the prior art and the present invention. They are not intended to indicate the relative size and dimensions of a contact cleaning system or components thereof.

DETAILED DESCRIPTION OF THE DRAWINGS

Figure 1:
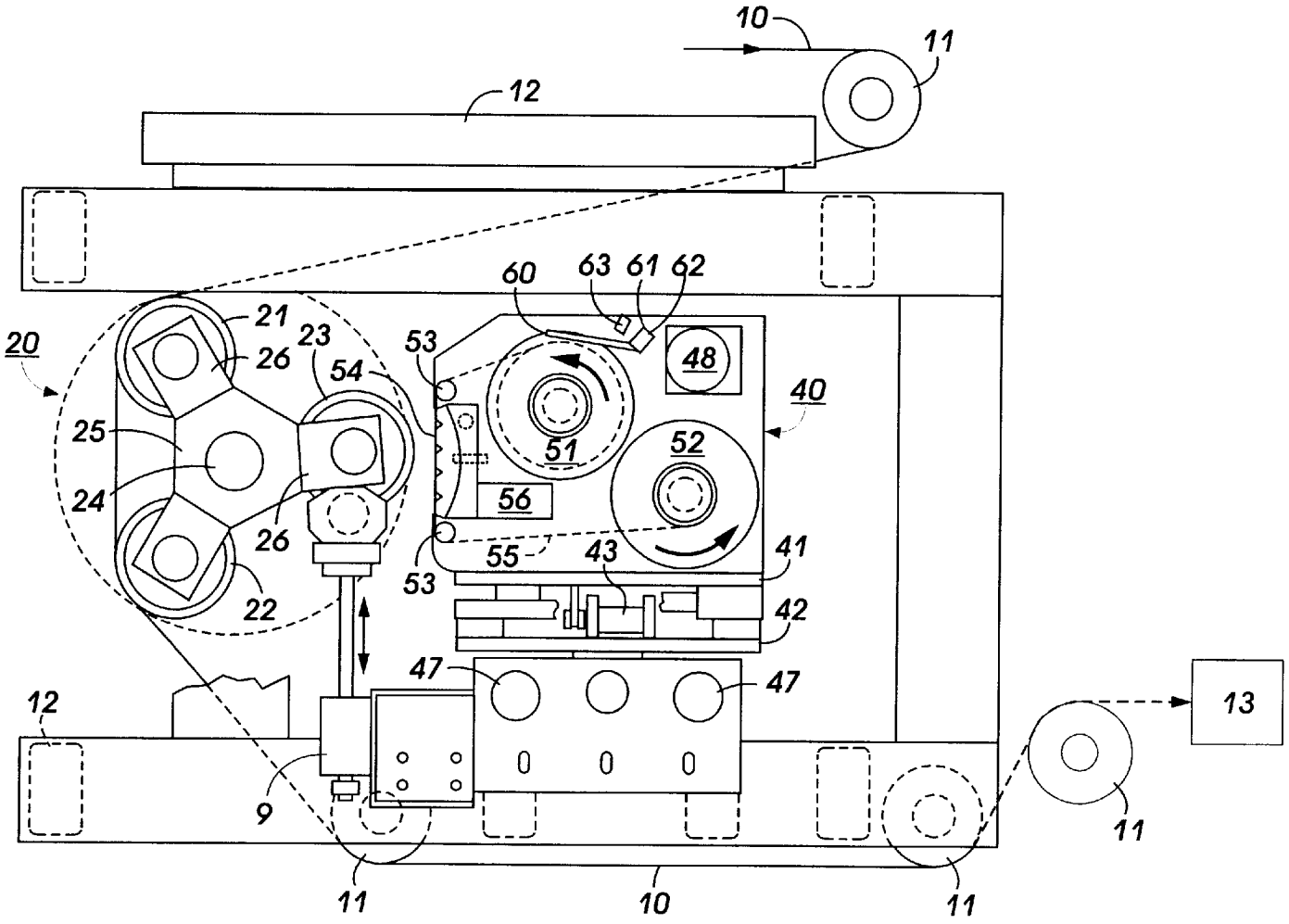
FIG. 1 is a schematic end elevation view of a contact cleaner roll system of this invention, with obscuring end structure removed.

FIG. 1 shows a contact cleaner roll system in a web processing apparatus. The web processing apparatus is indicated by a web 10 moving from left to right in a serpentine path over a series of idler rollers 11 on a frame 12. A conventional take up roll system 13 may be driven by any suitable device such as an activatable electric motor to transport web 10. Web 10 has two major exposed surfaces. A contact cleaner roll turret 20, including contact cleaner rolls 21, 22, 23, is mounted on the frame 12 in the path of the web 10. The cleaner rolls 21, 22, 23 are steel rolls, coated with a polymer for a tacky surface. The tacky surfaces of the cleaner rolls, in rolling contact with a major surface of the moving web 10, remove dirt particles of contamination from the major surface of web 10 as it rolls over the particles. The contact cleaner rolls in turn become contaminated and must be cleaned periodically to restore their effectiveness. A roll cleaner 40 is positioned adjacent to the contact cleaner roll turret 20 for movement into and out of engagement with it. Web 10 may comprise a web having a first major surface and a second major surface on opposite sides. Web 10 may comprise an uncoated web or, more preferably, comprises a web substrate having one or more coatings (not shown). Thus, for example, the first major surface and or the second major surface may comprise the outer surface of a coating or coatings. If transport of web 10 is stopped during a coating process for any extended period, adhesion of the cleaner rolls 21 and 22 to the outer surface of a coating or coatings of web 10 increases with time and, depending upon the time of contact and the type of materials utilized, may exceed the structural and peel strength of any of the coated layers thereby causing delamination of the coating or coatings upon restarting of the web coating line by activation of a driven roller 11 or by activation of a conventional, driven take up roll system 13. Uncoated webs produce similar increases in adhesion with contact cleaning rolls. Upon restarting of the web transporting system such as driven take up roll system 13, adhesion of the cleaning rolls to the coated or uncoated web 10 can cause wrinkling or stretching of the web, or even cause the web 10 to tear.

Figure 2:
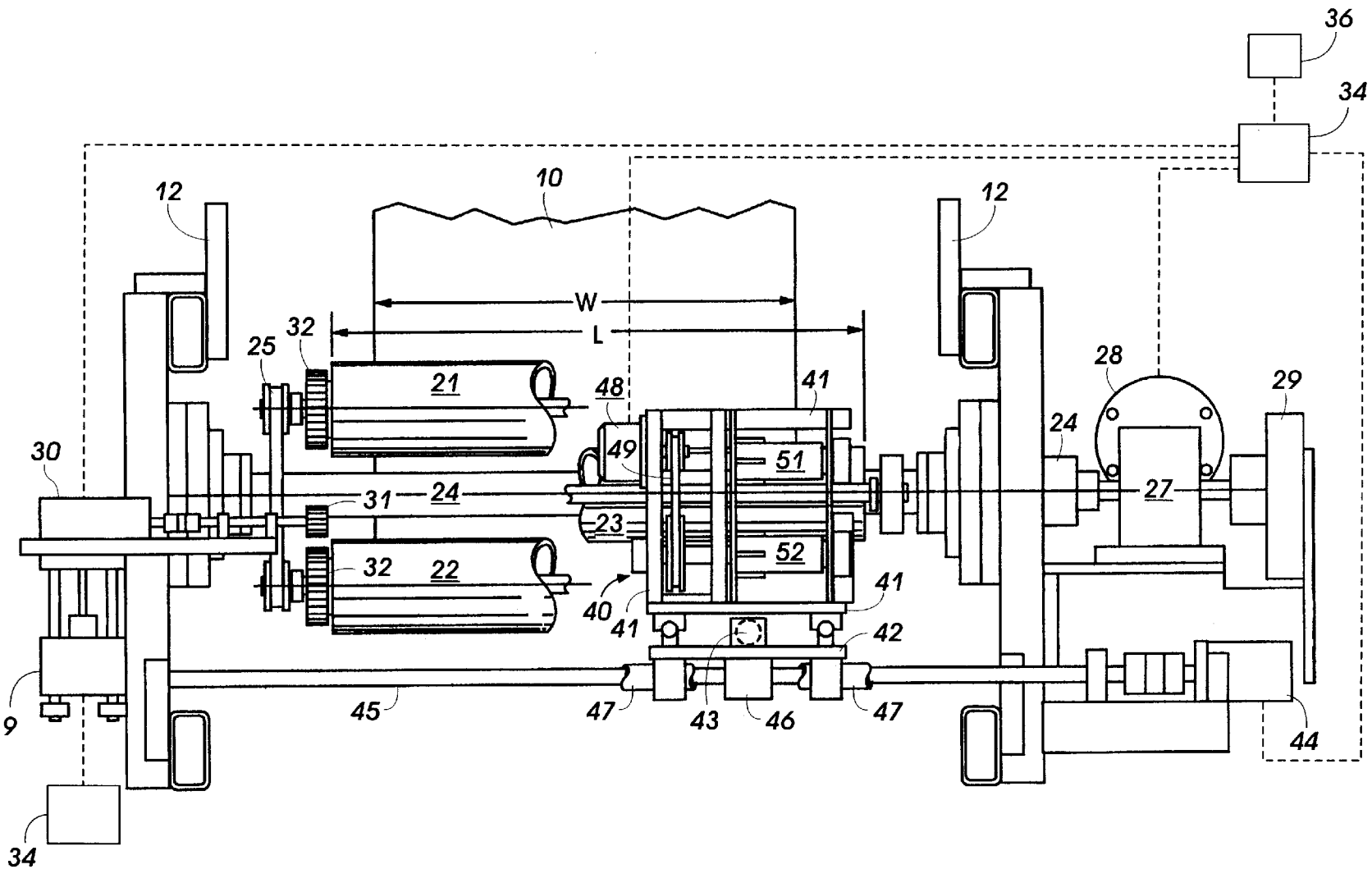
FIG. 2 is a schematic front elevation view from the right of FIG. 1, with obscuring front structure removed.
Figure 3:
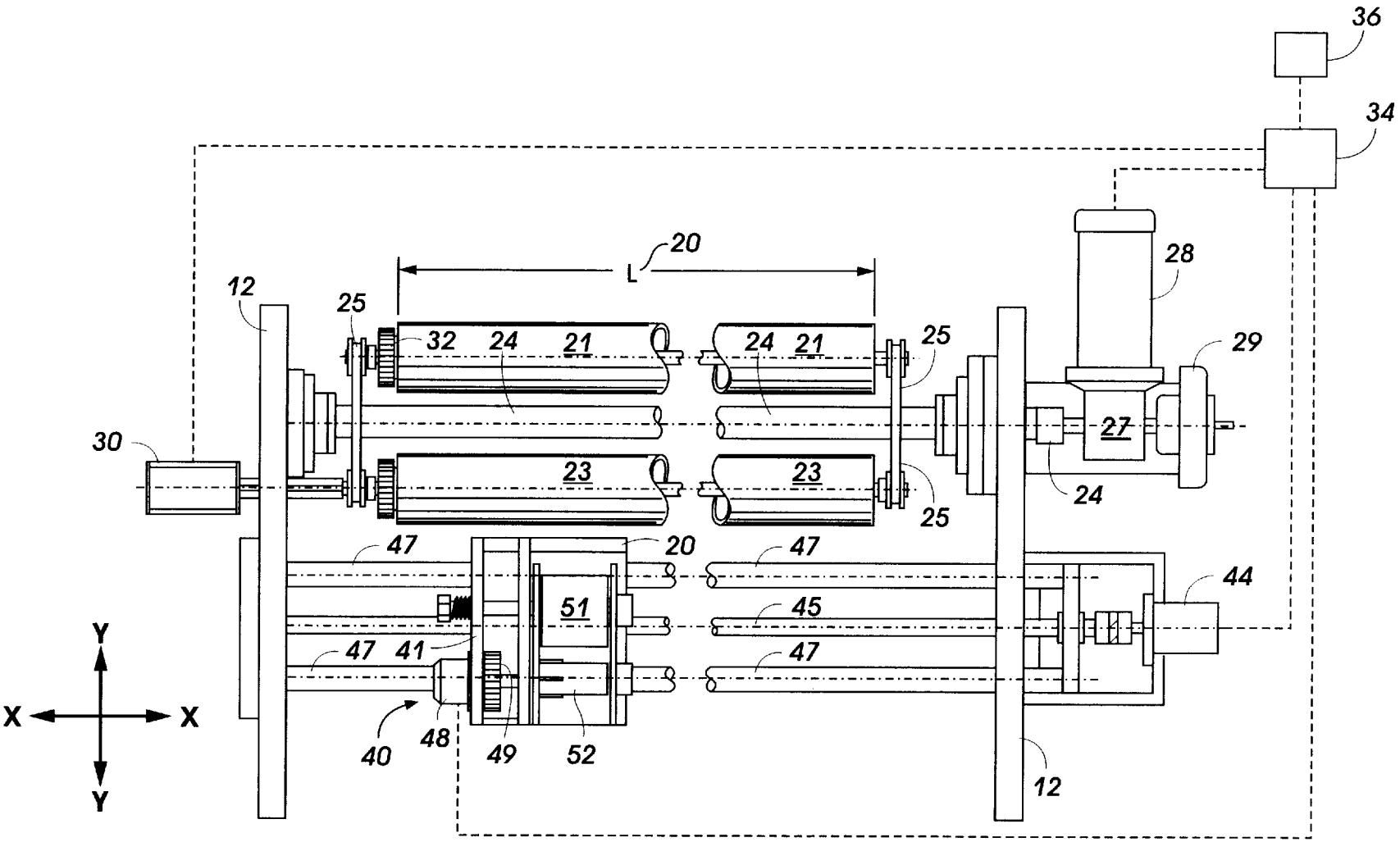
FIG. 3 is a schematic top view of FIG. 2, with obscuring top structure removed.

FIGS. 2 and 3 are front and top views, further showing the relationship of the frame 12, the roll turret 20, and the contact cleaner rolls 21, 22, 23. The cleaner rolls 21, 22, 23 are of length L to span the full width W of the moving web 10 (L being greater than W).

In FIGS. 1–3, the cleaner roll turret 20 includes a rotatable turret shaft 24 extending from end to end of the frame 12, with an end plate 25 fixed to it at each end. Each end plate includes three radial arms 26, each supporting one end of a rotatable cleaner roll. The turret shaft 24 is connected through a suitable gear train 27 to a motor 28 and to a locking brake 29. The turret shaft 24 is positioned with two of its cleaner rolls 21, 22 active, in rolling contact with a major surface of the moving web 10 to clean the major surface. The third cleaner roll 23 is out of contact with the web 10, idle and out of service for its own cleaning. Motor 28 is a reversible smart motor which may controlled by any suitable device such as a programmable controller 34. A typical programmable controller is Model No. 550, available from Allen-Bradley. If desired, an air motor (not shown) may be utilized instead of motor 28. Programmable controller 34 sends an electrical signal to actuate motor 28 so that motor 28 periodically rotates the turret 20 by an appropriate amount, 1200 in this example, to take one cleaner roll out of service and to put another cleaner roll into service. Controller 34 is programmed so that, in the event that transport of web 10 is stopped during a coating process for any extended period, programmable controller 34 sends an electrical signal to motor 28 to periodically rotate the turret 20 by the appropriate amount, in one direction and to thereafter rotate turret 20 by an appropriate amount in the opposite direction. Preferably, the amount of rotation of cleaner rolls 21 and 22 should be sufficient to bring a fresh area of cleaner rolls 21 and 22 into contact with web 10 and to separate from web 10 those areas of cleaner rolls 21 and 22 that were previously in contact with web 10 immediately following interruption of web transport, i.e. moment of coating line stoppage. The degree of roll rotation to accomplish this depends upon various factors such as the diameter of the roll and the amount of web wrap around the roll. A signal indicating stoppage of the coating line can be sent to the controller 34 by any suitable means such as a conventional speed detector 36 through the processor of driven take up roll system 13. For convenience, the combination of controller 34 and motor 28 or suitable alternatives thereof are referred to herein as an indexing device. Thus, generally, this indexing device is adapted to cyclically roll at least one rotatable contact cleaner roll against a first major surface of a coated web in one direction and to thereafter roll the rotatable contact cleaner roll against the first major surface in the opposite direction during the time period when transport of the web past a rotatable contact cleaner roll is interrupted. This cyclical back and forth movement of the rotatable contact cleaner roll (or a plurality of cleaner rolls carried in a turret) against the web surface may be for example, (1) initiated immediately after transport of the web past the rotatable contact cleaner roll is interrupted or (2) initiated after a brief hiatus following interruption of transport of the web past the rotatable contact cleaner roll. Further, following the initial rolling of at least one rotatable contact cleaner roll against a first major surface of a web in a first direction, rolling in the opposite direction may be initiated immediately or after the imposition of a brief rest period prior to rolling of the rotatable contact cleaner roll in the opposite direction. The specific time period for stationary contact depends upon the materials utilized in the web coating and in the contact cleaning roll coating. However, the length of the aforesaid brief hiatus and imposed rest period should be sufficiently short to prevent the adhesion between the contact cleaner roll and the web surface to build up to a level where delamination of a coating or other damage to the web occurs when the transport of the web is restarted. Generally, the period of any stationary contact between the rotatable contact cleaner roll against the coated web surface should be less than about 15 minutes to avoid delamination of a coating from the web substrate. Preferably, the period of stationary contact is less than about 1 minute. Generally, the rolling of the contact cleaner roll against a coated web surface in the first direction and in the opposite direction are in a direction that is longitudinal of the web.

In FIGS. 2 and 3, a speed match drive motor 30 with a drive pinion 31 is mounted on the frame 12. Each of the cleaner rolls 21, 22, 23 has a drive gear 32 attached to it. The drive pinion 31 engages the drive gear 32 of the out-of-service cleaner roll (roll 23 in FIGS. 1 and 3) while cleaner rolls 21 and 22 are in rolling contact with moving web 10. Drive pinion 31 and motor 30 are not engaged while the cleaner roll turret is being rocked back and forth during interruption of web transport, i.e. when transport of web 10 has been stopped. Both drive pinion 31 and motor 30 are mounted to air cylinder 9. When the turret 20 is to be rocked back and forth, air cylinder 9 is retracted away by controller 34. The drive motor 30 drives the out-of-service roll 23 and maintains its proper running speed to bring it back on line in rolling contact with the moving web 10. It is important to match the speed of the roll 23 with the speed of the web 10 The roll 23 is tacky and adhesive, and if the speeds of the web 10 and roll 23 do not match, the roll 23 will grab, disrupt, and even damage the moving web 10 when the web 10 and roll 23 are brought together. An automatic roll cleaner 40 may be used to clean the idle cleaner roll 23.

During the interruption of web transport, the contact cleaning roll of the trirollers in turret 20 not in contact with the web cleaning, i.e. roll 23, may or may not be ready for contact cleaning of web 10. For example, the roll 23 may be unclean and covered with particles on the outer surface. Also, at the moment of web transport interruption, cleaning of the roll 23 may have only been partially completed so that it still carried wet cleaning solution on its outer surface. Contact of a wet or dirty contaminated cleaning roll 23 with the web 10 could produce further defects. To keep contaminated cleaning roll 23 out of contact with web 10 and to prevent long contact periods of rollers 21 and 22 against the web 10, the direction of rotation of turret 20 and rollers 21 and 22 are preferably reversed in systems utilizing the turret 20.

Figure 4:
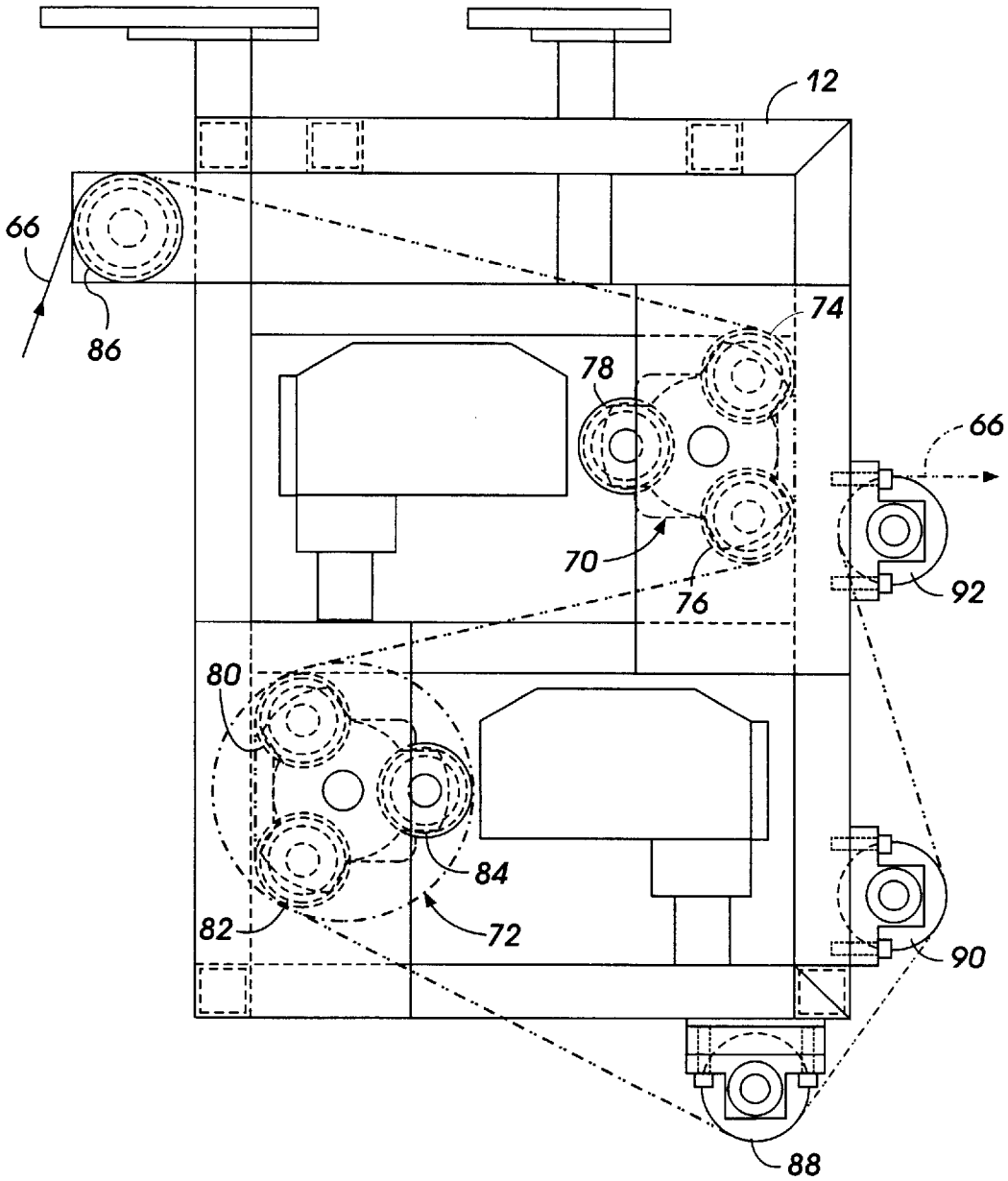
FIG. 4 is a schematic front elevation view of a cleaning system embodiment of this invention in which a plurality of contact cleaner rolls support, clean and guide a moving web in a substantially "S" shaped path and an indexing device rocks the cleaning rolls back and forth when movement of the web past the cleaner rolls is interrupted.

Referring to FIG. 4, a plurality of contact cleaner roll turrets 70 and 72 are shown mounted on the frame 12 in the path of the electrostatographic imaging web substrate 66. Contact cleaner roll turret 70 includes contact cleaner rolls 74, 76 and 78 and contact cleaner roll turret 72 includes contact cleaner rolls 80, 82 and 84. The components of contact cleaner roll turrets 70 and 72 are identical to the components of contact cleaner roll turret 20 described above. Thus, contact cleaner rolls 74, 76, 78, 80, 82 and 84 are steel rolls, coated with a polymer for a tacky surface. The contact cleaner roll turrets 70 and 72 are positioned on frame 12 so that contact cleaner rolls 74 and 76 contact a first major surface on one side of electrostatographic imaging web substrate 66 and contact cleaner rolls 80 and 82 contact a second major surface on the side of electrostatographic imaging web substrate 66 opposite the first major surface. The contact cleaner roll turrets 70 and 72 are also positioned on frame 12 to support and guide moving electrostatographic imaging web substrate 66 in a substantially "S" shaped path to clean both sides of web substrate 66 in an extremely short and compact path with contact between the web substrate 86 and the contact cleaner rolls being under substantially the same pressure for more uniform cleaning results. The lateral orientation of the rollers can be adjusted to vary the wrap angle, thus providing optimal cleaning. Idler roll 86 feeds electrostatographic imaging web substrate 66 to turret 70 and idler rolls 88, 90 and 92 guide web substrate 66 away from turret 72 to a take up roll or another processing station (not shown). For the sake of convenience, the expression electrostatographic imaging web substrate as employed herein is intended to include an uncoated or coated substrate component of an electrostatographic imaging member such as, for example, a film coated with a conductive layer, a film coated with a conductive layer and a charge blocking layer, and the like.

Figure 5:
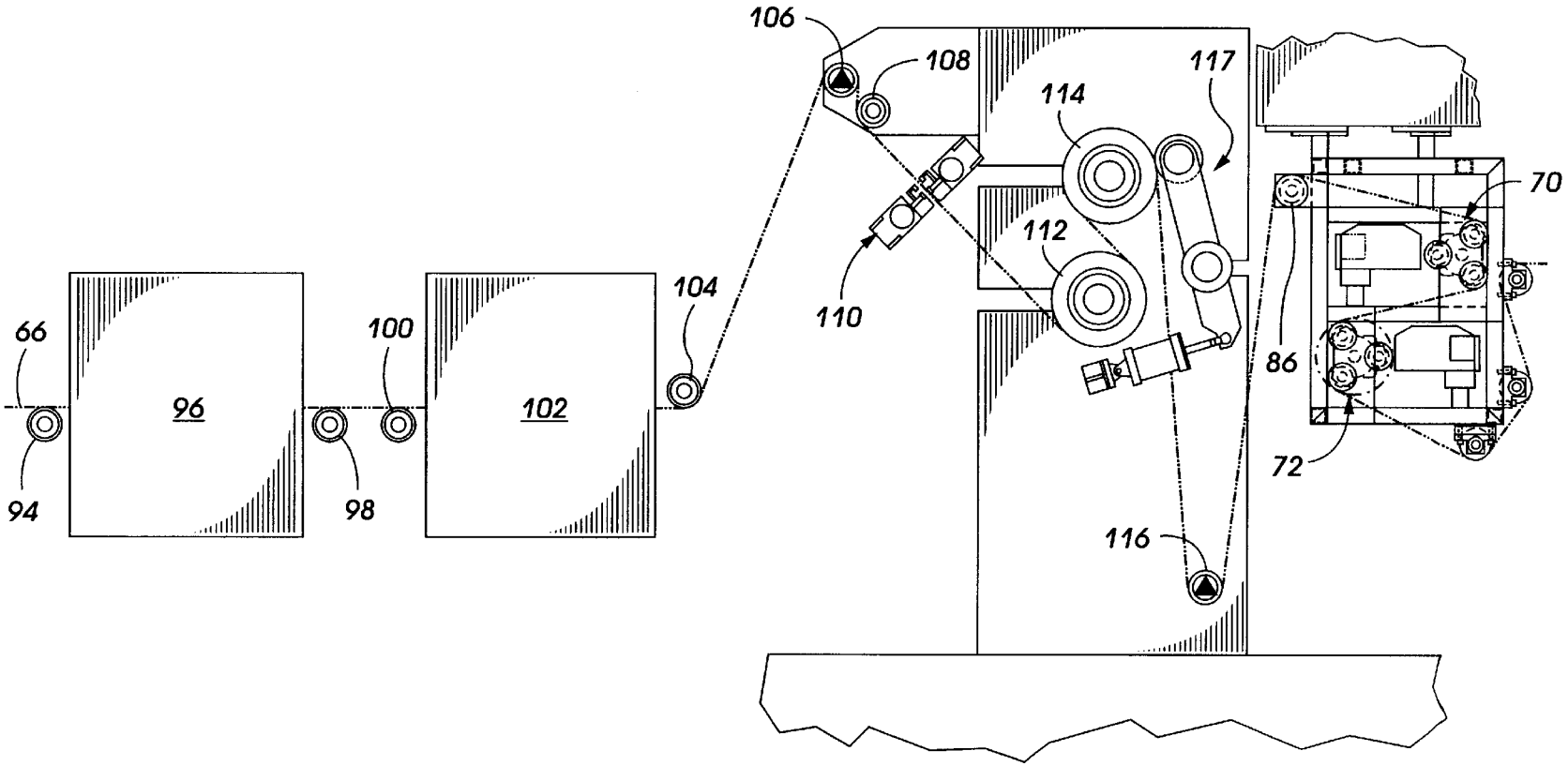
FIG. 5 is a schematic front elevation view of the cleaning system embodiment shown in FIG. 4 utilized in combination with other web processing stations.
Figure 6:
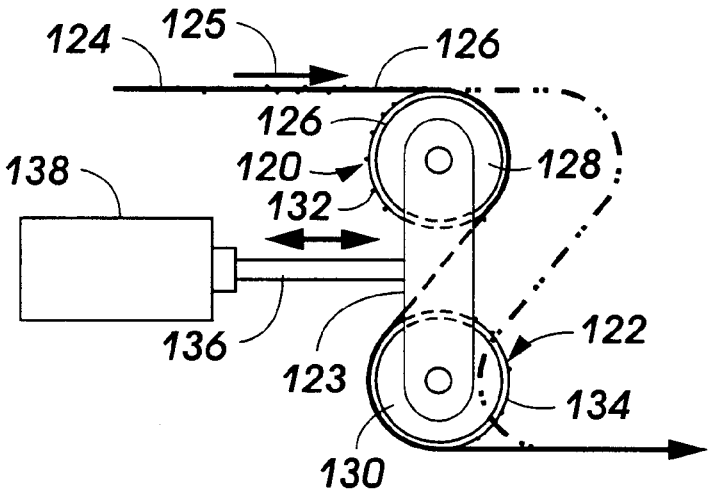
FIG. 6 is a schematic front elevation view of another cleaning system embodiment of this invention in which a plurality of contact cleaner rolls support, clean and guide a moving web in a substantially "S" shaped path.
Figure 7:
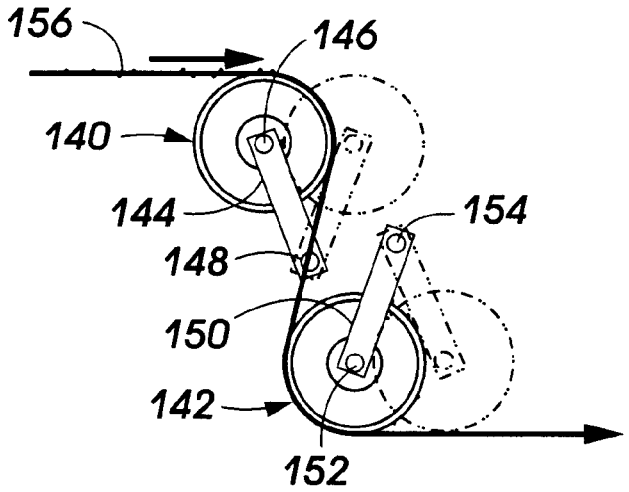
FIG. 7 is a schematic front elevation view of another cleaning system embodiment of this invention in which a plurality of contact cleaner rolls support, clean and guide a moving web in a substantially "S" shaped path.

Shown in FIG. 5 is a coating subsystem utilizing the plurality of contact cleaner roll turrets 70 and 72 illustrated in FIG. 4. More specifically, electrostatographic imaging web substrate 66 is fed from a supply roll or another processing station (not shown) over idler roll 94 into coating station 96 where a coating is applied. After application of a coating, electrostatographic imaging web substrate 66 is then fed over idler rolls 98 and 100 into drying station 102. Subsequent to drying in drying station 102, web substrate 66 travels around idler rolls 104, 106, 108 and through air knife/vacuum station 110 for removal of large dirt particles having an average size greater than about 30 to 100 micrometers. The minimum particle size that can be removed from web substrate 66 by a non contacting cleaning station varies with the specific type of non contacting cleaning system selected and can be as low as about 30 micrometers with some non contacting cleaning systems being incapable of removing particles having an average size less than about 100 micrometers. Web substrate 66 then travels around chill rolls 112 and 114, around idler roll 116 and idler roll 86 to contact cleaner roll turrets 70 and 72, the roll turrets being shown in greater detail in FIG. 4. A reciprocatable nip roll assembly 117 comprising a nip roll, pivot arm and two way acting air cylinder, may be employed to ensure more uniform contact between chill roll 114 and web substrate 66. Coating station 96 may comprise any suitable and conventional coating station such as a gravure applicator system which applies a charge blocking layer, an extrusion applicator system which applies a charge generating layer or charge transport layer, or any other suitable coating system. Drying station 102 may comprise any suitable non-contact drying system such as a conventional oven, a forced air oven, a radiant heater, steam heater, electric heater, microwave, and the like. The preferred embodiment uses a floatable oven convention. An alternative to the multiple contact cleaner roll turrets 70 and 72 shown in FIGS. 4 and 5, is the use of multiple single contact cleaner rolls 120 and 122 illustrated in FIG. 6. In this embodiment, single contact cleaner rolls 120 and 122 are mounted on a pair of parallel end plates 123 to support and guide moving electrostatographic imaging web substrate 124 in a substantially "shaped path. The direction of movement of electrostatographic imaging web substrate 124 is shown by the arrow 125. As apparent from a comparison of the web substrate paths shown in FIGS. 5 and 6, the expression "substantially S shaped path" is intended to encompass "S", "Z" and similarly shaped serpentine paths around at least two contact cleaning turrets or at least two single contact cleaning rolls. The incoming portion of electrostatographic imaging web substrate 124 is coated on both major surfaces with dirt particles 126. Single contact cleaning roll 120 removes dirt particles 126 from one major surface of electrostatographic imaging web substrate 124 and single contact cleaning roll 122 removes dirt particles 126 from the major surface on the opposite side of electrostatographic imaging web substrate 124. If desired, each of the contact cleaner rolls 120 and 122 may comprise an electrically conductive core 128 and 130, respectively, coated with an electrically insulating contact cleaning material 132 and 134, respectively. When the dirt particles all carry a charge of a given polarity, an electrical bias of the opposite polarity may be imparted to the electrically conductive cores 128 and 130 by any suitable means such as slip rings and conductive brushes (not shown). If some of the dirt particles on a major surface of web substrate 124 carry a charge of one polarity and other dirt particles on the same major surface carry a charge of the opposite polarity, the electrically conductive cores of one pair of rollers supporting and guiding the moving web in a substantially "S" shaped path can be biased to one polarity and the electrically conductive cores of another pair of similar rollers downstream of the first pair of rollers can be biased to the opposite polarity. Alternatively, where a pair of tandem rollers are in sequential contact with one major surface of web substrate, as in one of the turrets illustrated in FIGS. 4 and 5, one of the pair of rollers may be biased to one polarity and the other biased to the opposite polarity. An electrical bias is created by establishing an electrical potential between the electrically conductive core of the contact cleaning roll and an electrically conductive layer in or behind the web substrate 124 (such as a vacuum deposited metal layer not shown) or an electrically conductive backing roll (not shown) located on the opposite side of web substrate 124 from the biased contact cleaning roll. Any suitable electrical biasing means (not shown) may be employed such as those conventionally used for electrically biasing magnetic brush applicator rolls for electrophotographic image development systems. For example a D.C. potential may be applied using a battery or A.C. rectifier. The resulting electrostatic field assists in drawing the dirt particles from the web substrate surface to the electrically insulating contact cleaning roll surface. This system can also be used to selectively remove surface particles. For example if retention of photoreceptor component particles on the web substrate surface is desirable and the component particles are all of one polarity, a biased contact cleaning roll could be imparted with the same charge polarity as the component particles thereby repelling the component particles but attracting dirt particles carrying an electrical charge of the opposite polarity. In order to maintain tension and keep the web stationary, the cleaning rolls 120 and 122 illustrated in FIG. 6 maybe connected to an air cylinder arm 136 which is moved back and forth by two way acting air cylinder 138. Both rolls 120 and 122 are moved in the same direction and distance. Illustrated in FIG. 7 is an alternative arrangement for rotatable single contact cleaner rolls 140 and 142. One end of a pair of parallel pivot arms 144 support the axle shaft of 146 of contact cleaning roll 140 and the opposite ends of the pivot arms 144 are fixed to a shaft 148 pivotably supported by a frame (not shown). Similarly, one end of another pair of pivot arms 150 support the axle shaft of 152 of contact cleaning roll 142 with the opposite ends of the pivot arms 150 being fixed to a shaft 154 pivotably supported by a frame (not shown). Smart motors (not shown) or other suitable device (e.g. a solenoid or two way acting air cylinder) rotate the shaft 148 and 154 to pivot the arms 144 and 150 to impart a back and forth rocking action to the contact cleaning rolls 140 and 142 (see phantom lines) when transport of web 156 is stopped. This arrangement permits rolls 140 and 142 to be rocked back and forth with only localized movement of web 156 without transporting the entire web 156 back and forth.

Figure 8:
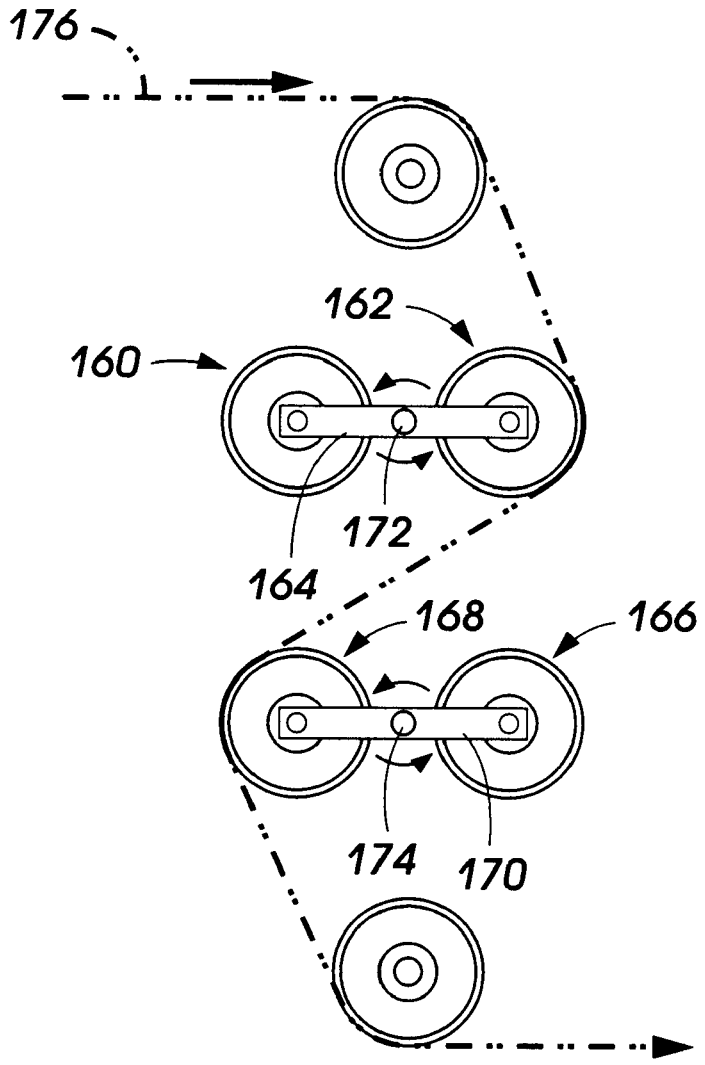
FIG. 8 is a schematic front elevation view of another cleaning system embodiment of this invention in which a plurality of contact cleaner rolls and other rolls support, clean and guide a moving web in a substantially "S" shaped path.

Still another alternative design is shown in FIG. 8 wherein a pair of contact cleaning rolls 160 and 162 are rotatably mounted at opposite ends of a pivotable pair of parallel arms 164 and another pair of contact cleaning rolls 166 and 168 are rotatably mounted at the opposite ends of a pivotable pair of parallel arms 170 The centers of the pairs of parallel arms 164 and 170 are fixed to shafts 172 and 174, respectively. Shafts 172 and 174 are rotatably supported by a frame (not shown). Rotation of each of the shafts 172 and 174 is effected by a smart motor (not shown) or other suitable device. Rotation of the shafts 172 and 174 causes the parallel arms 164 and 170 to pivot in the direction shown by the arrows through an arc of, for example, 1800. Thus, the pair contact cleaning rolls 160 and 162 and the pair contact cleaning rolls 166 and 168 are moved in the same direction for the same distance. This arrangement permits the positions of the contact cleaning rolls on the pivotable pair of parallel arms to be interchanged with only localized movement of web 176 without transporting the entire web 176 back and forth.

The systems of this invention comprising multiple contact cleaner rolls which clean both major surfaces of a web moving in a substantially "S" shaped path or a single contact cleaning roll contacting one major surface of a web can be employed after unwinding a web substrate from a supply roll, prior to application of coating, after drying of a coating, subsequent to slitting of the web substrate, prior to winding the web substrate on a take up roll, or at any other suitable stage in the fabrication and processing of an electrostatographic imaging web substrate. Optimum results are achieved when an electrostatographic imaging web substrate is cleaned with the cleaning system of this invention prior to and subsequent to the application of an electrically conductive layer, a charge blocking layer, an optional adhesive layer, a charge generating layer, a charge transport layer and optional overcoating layer. Generally, after a web substrate is coated with the charge blocking layer and adhesive layer, the coated web substrate is rolled up into a roll and transported to another coating station. During unrolling of the coated web, static electricity is generated as the outermost ply of the coated web is separated from the roll. Since this static electricity tends to attract dirt particles to the exposed surfaces of the web, the web is preferably cleaned again prior to application of a charge generating layer. After drying of the charge generating layer, the coated surface is preferably cleaned prior to application of the charge transport layer. In some embodiments, the charge transport layer is deposited on the web or drum prior to the charge generating layer. The contact cleaning systems of this invention may also be utilized to clean a web prior to and/or subsequent to the application of a bar code. Further, the web may be cleaned with the contact cleaning system of this invention prior to and subsequent to the application an anti-curl backing layer to the rear surface of the coated web. Preferably a plurality of contact cleaning roll surfaces are sequentially brought into contact with each major surface of the electrostatographic imaging member web substrate to be cleaned as illustrated, for example in FIGS. 4 and 5. The axes of the contact cleaning rolls employed in the contact cleaning system of this invention are preferably parallel to each other to insure adequate web handling and guiding and one contact cleaning roll contacts a major surface to be cleaned prior to contact of the same major surface with another contact cleaning roll. This arrangement promotes improved cleaning, particularly where dirt accumulates on a particular region on the first roller as it eventually lead to the formation of a repeating pattern of poorly cleaned repeatedly contacts the web substrate during roll rotation. Accumulation of dirt on a specific region of a single cycling contact cleaning roll can regions on the substrate during the cleaning process because of the reduced cleaning effectiveness of the contaminated regions on the cycling contact cleaning roll.

Generally, synchronous contact between the contact cleaning member and the moving surface of a web to be cleaned is preferred to prevent any scrubbing action which can remove material of either the contact cleaning member or the surface to be cleaned. This prevents the formation of scratches on either the surface of contact cleaning member or the moving surface of the substrate to be cleaned. Synchronous speeds may be achieved by any suitable technique such as separate synchronized motor drives for the member being cleaned and the contact cleaning member. Alternatively, either the moving web being cleaned or the contact cleaning member can be driven by the other by frictional contact. Also, the electrostatographic imaging member web substrate is maintained under tension by conventional means such as supply roll brakes, spring loaded idler rolls (not shown) and the like to ensure pressure contact with the contact cleaning roll surface during cleaning. However, when transport of the moving web is stopped, the contact cleaning roll or rolls are moved back and forth relative to the web surface. During back and forth movement of the contact cleaning roll or rolls, contact between the contact cleaning roll surface and the surface of the web remains synchronous. Although overall transport of the web has stopped, the contact cleaning rolls move back and forth, either continuously or with brief pauses between the back and forth movements. In a less preferred embodiment, a roll is moved in a single direction to bring a different cleaning surface of the same roll or different contact cleaning roll into contact with the web while transport of the web is stopped. The contact cleaning surface may comprise a deposited coating on a supporting core member or it may make up the entire cleaning member. A soft conformable contact cleaning material at the surface of the cleaning roller is preferred to ensure greater surface area of contact between the contact cleaning surface and the dirt particles than between the dirt particles and the electrostatographic imaging web substrate. Thus, the durometer of the contact cleaning material is preferably less than the durometer of the materials in the electrostatographic imaging web substrate.

There does not appear to be any criticality in the diameter of a contact cleaning roller. However, smaller diameter contact cleaning rolls have less surface available for accumulating dirt particles and tend to become overly dirty more rapidly. Longer contact times promote better adhesion and removal of dirt particles from the web. Moreover, a small diameter cleaning roll can bend if the roll is too long or if it comprises material that is too soft. It may be preferable to have the cleaning roll have a different diameter than the other rollers in the process to aid in troubleshooting repeat defects.

Any suitable tacky cleaning material may be used on the contact cleaning webs or rollers of this invention. Preferably the tacky material will not produce a residual material on the web being cleaned. Typical tacky cleaning materials include the medium tack materials utilized in "Post-it®" sheets available from the 3M Company. A square test sample having a width of about 5 centimeters of paper coated with medium tack materials such as employed in Post-it® type adhesives will stick to a human finger when the finger is pressed against the adhesive surface and thereafter lifted. These test samples will retain a dirt particle having an average particle size of between about 0.5 micrometer and about 100 micrometers when the test sample is pressed against the particle and lifted away from any smooth surface upon which the dirt particle originally rested. This test defines the expression "medium tack surface" as employed herein. Tacky materials employed in the medium tack coating are believed to contain tacky polymeric elastomeric alkyl acrylate or alkyl methacrylate ester material. Typical medium tack materials are disclosed, for example, in U.S. Pat. No. 4,994,322, the entire disclosure thereof being incorporated herein by reference. The tacky rubber materials utilized in the contact cleaning members of this invention can have a low tack. The expression "low tack" as employed herein is defined as a tacky surface to which dirt particles having a size less than about 100 micrometers adhere, but to which a human finger does not adhere. Thus, a square test sample piece having a thickness of about 2 millimeters and a width of about 1 centimeter cannot be picked up when a human finger is pressed down against the sample and thereafter lifted. However, when the test sample is pressed against a dirt particle having an average particle size of between about 0.5 micrometer and about 100 micrometers, the dirt particle will adhere to the test sample when the test sample is lifted away from any smooth surface upon which the dirt particle originally rested. The low tack materials utilized in the contact cleaning roller of this invention may comprise any suitable adhesive material. Typical low tack materials include, for example, polyurethane, natural rubber, and the like. A typical low tack rubbery cross-linked polyurethane material is available from Polymag, Rochester, N.Y. and R. G. Egan, Rochester, N.Y. The low tack rubbery cross-linked polyurethane material has a durometer of about 15–35 Shore A. Low tack rubbery cross-linked polyurethane materials are described in U.S. Pat. Nos. 5,102,714 and 5,227,409, the entire disclosures thereof being incorporated herein by reference. The amount of adhesion of the contact cleaning surface to the surface of any coated substrates during contact cleaning should be less than the peel strength of the coating being cleaned to ensure that when the contact cleaning surface is separated from the surface being cleaned, the coating remains undamaged on the substrate. Since the peel strength of coatings on the substrate varies with the type of materials employed in the substrate and in coating, the amount of tack exerted by a contact cleaning member can vary depending upon the specific materials employed in substrate and coating. For example, a low tack contact polyurethane contact cleaning member surface is preferred for cleaning substrates vacuum coated with thin metalized coatings, e.g. aluminized polyethylene terephthalate films. Low tack is also desirable for cleaning a low peel strength adhesive layer on a photoreceptor substrate to prevent removal of the adhesive coating when the contact cleaning surface is separated from the adhesive layer. However, the amount of tackiness on a contact cleaning member surface should also be sufficient to remove particles having an average particle size between about 0.5 micrometer and about 200 micrometers when the contact cleaning surface is separated from the surface being cleaned. As described above, the amount of adhesion of a coated substrate to a contact cleaning roll during contact cleaning can be less than the peel strength of the coating being cleaned during momentary contact situations, but can build up to exceed the peel strength during stationary contact. By imparting a rocking movement to the contact cleaning roller after web transport has been interrupted, such adhesion build up can be avoided alternatively, in a less preferred embodiment, a roll is moved in a single direction to bring a different (out of contact) cleaning surface of the same roll or different contact cleaning roll into contact with the web while transport of the web is stopped. In any embodiment, the contact cleaning surface that was in contact with the web, at the moment when transport of the web was stopped, is separated from contact with the web immediately or within a preselected period of time from the moment of stoppage of web transport and prior to restarting of web transport.

Preferably, the color of the contact cleaning surface is different from the color of the dirt removed from the surface to be cleaned to provide contrast between the color of the dirt particles and the color of the contact cleaning surface. This facilitates determination of when the contact cleaning rolls should be cleaned or replaced and where the dirt particles are located on the contact cleaning surface. Both the contact cleaning surface of the rolls of this invention and the electrostatographic imaging member web substrate to be cleaned should be sufficiently smooth to ensure contact between the contact cleaning surface and the dirt particles on the surface to be cleaned. Thus, the contact cleaning surface should be continuous. The contact cleaning surface should also not form any deposits on the surface of the electrostatographic imaging member to be cleaned because such deposits may adversely affect the electrical properties of the final electrostatographic imaging member.

Generally, a contact or wrap angle between the web being cleaned and the contact cleaning roll of more than about 600 of arc measured in the direction of travel is preferred because this ensures maximum contact, even tension and also ensures uniform roller to web speed. It also provides adequate contact time for particles to adhere to the cleaning roll. Angles less than about 60 degrees may result in slippage and inefficient cleaning. Preferably, (during web stoppage), the amount of rotation of the contact cleaner rolls should be sufficient to bring a fresh area of cleaner rolls into contact with the web and to separate from the web those areas of the cleaner rolls that were previously in contact with the web immediately following interruption of web transport. For example, where the wrap angle of a web occupies 600 of arc, the contact cleaning roll is preferably rotated at least about 600 of arc after stoppage of the coating line.

Large particles of dirt clinging to a contact cleaning member surface can emboss or even scratch a surface to be cleaned as the contact cleaning surface is cycled around a fresh surface to be cleaned. This can occur on a cycling contact cleaning belt or rotating contact cleaning roller. Thus, it is desirable that any large dirt particles have an average particle size of larger than about 100 micrometers be removed prior to bringing a contact cleaning surface into contact with the surface to be cleaned. Such removal of these relatively large particles also ensures that particles are not present to mask smaller underlying particles during subsequent contact cleaning. Any suitable technique such as air jet cleaning, vacuum cleaning, air impingement, ultrasonic resonation, and the like and combinations thereof may be utilized to remove particles having an average particles size greater than at least 100 micrometers. Although a specific cleaning technique and apparatus are shown in the figures, any other suitable cleaning technique may be utilized to clean the contact cleaning members. The cleaning technique selected depends upon the type of dirt particles picked up by the cleaning member surfaces. Any liquid cleaning material utilized to clean off the contact cleaning member surface is preferably selected from materials that will wet and spread readily on the cleaning roll, will be safe during use, will dry in a reasonable time, and will not leave a residual on the cleaning roll. Satisfactory results have been achieved with cleaning materials comprising a mixture of water and alcohol. Typical alcohols include, for example, methanol, ethanol, isopropyl alcohol and the like. Generally, the mixture comprises between about 75 percent and about 99 percent by weight water and between about 1 percent and about 25 percent by weight alcohol. The preferred concentration comprises between about 78 and about 82 percent by weight water and between about 18 and about 22 percent alcohol.

When cleaning of the contact cleaning surface becomes less effective and where the thickness of the contact cleaning material is adequate, some of the surface of the contact cleaning surface may be ground or ablated away to remove any embedded dirt present and to also remove some of the ineffective contact cleaning material thereby exposing fresh contact cleaning material.

Preferably, cleaning and coating operations for fabricating electrostatographic imaging members are conducted under clean room conditions such as those at least meeting the requirements of a Class 1000 Clean Room. A Class 1000 Clean Room is defined as a one cubic foot volume of space which does not have a particle count of more than 1000. If desired, more stringent clean room conditions may be utilized. However, for very large coating operations occupying a large volume of space, more stringent cleaning room conditions are more difficult and more expensive to achieve.

Electrostatographic flexible web imaging members are well known in the art. Typical electrostatographic flexible web imaging members include, for example, photoreceptors for electrophotographic imaging systems and electroceptors or ionographic members for electrographic imaging systems. Electrostatographic flexible web imaging member may be prepared by various suitable techniques. Typically, a flexible web substrate is provided having an electrically conductive surface. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is formed on the charge generation layer. For ionographic imaging members, an electrically insulating dielectric layer is applied to the electrically conductive surface.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate should be flexible and in the form of an endless flexible belt. Preferably, the endless flexible belt shaped substrate comprises a commercially available biaxially oriented polyester known as Mylar, available from E. I. du Pont de Nemours & Co. or Melinex available from IC/.

The thickness of the web substrate layer depends on numerous factors, including beam strength and economical considerations, and thus this layer for a flexible web may be of substantial thickness, for example, about 125 micrometers, or of minimum thickness less than 50 micrometers, provided there are no adverse effects on the final electrostatographic device. In one flexible web embodiment, the thickness of this layer ranges from about 65 micrometers to about 150 micrometers, and preferably from about 75 micrometers to about 100 micrometers for optimum flexibility and minimum stretch when cycled as a belt around small diameter rollers, e.g. 19 millimeter diameter rollers. The surface of the substrate layer is preferably cleaned prior to coating to produce higher quality coatings. Cleaning is preferably effected with the cleaning system of this invention.

The conductive layer may vary in thickness over substantially wide ranges depending on the optical transparency and degree of flexibility desired for the electrostatographic member. Accordingly, for a flexible photoresponsive web imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal or metal alloy layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like. Regardless 0 the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known in the art and typical blocking layer materials are disclosed, for example, in U.S. Pat. Nos. 4,291,110, 4,338,387, 4,286,033 and 4,291,110, the disclosures of which are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may be applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Typical photogenerating layer comprise inorganic or organic photoconductive pigment particles dispersed in a film forming binder as is well known in the art. Any suitable polymer film forming binder material may be employed as the matrix in the photogenerating binder layer. Typical polymeric film forming materials include those described, for example, in U.S. Pat. No. 3,121,006, the entire disclosure of which is incorporated herein by reference.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objective of the present invention are achieved.

Any suitable and conventional technique may be utilized to mix and thereafter apply the photogenerating layer coating mixture. Typical application techniques include spraying, dip coating, roll coating, wire wound rod coating, and the like. Drying of the deposited coating may be effected by any suitable conventional technique such as oven drying, infra red radiation drying, air drying and the like. The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

Any suitable inactive resin binder soluble in a suitable solvent may be employed in the process of this invention and any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layer include the charge generator layer and diamine containing transport layer members disclosed in U.S. Pat. No. 4,265,990, 4,233,384, 4,306,008, 4,299,897 and 4,439,507, the disclosures of these patents being incorporated herein in their entirety. The photoreceptors may comprise, for example, a charge generator layer sandwiched between a conductive surface and a charge transport layer as described above or a charge transport layer sandwiched between a conductive surface and a charge generator layer.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. A thickness between about 70 and about 160 micrometers is a satisfactory range for flexible web photoreceptors.

For electrographic imaging members, a flexible dielectric layer overlying the conductive layer may be substituted for the photoconductive layers. Any suitable, conventional, flexible, electrically insulating dielectric polymer may be used in the dielectric layer of the electrographic imaging member. If desired, the flexible belts of this invention may be used for other purposes where cycling durability is important.

This invention has application in other areas where long dwell times against web materials is detrimental. For example in the design of xerographic devices, long contact times of a support roll or supporting skid plate against an electrophotographic imaging belt can result in the crystallizing of belt components and/or adverse alteration of electrical properties of the belt. With an indexing device adapted to shift the position of the belt back and forth on a supporting roll or skid plate after initial stoppage of the belt will prevent prolonged stationary contact between the belt and the underlying roll or skid plate.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A supply roll of a long vacuum metalized polyethylene terephthalate web having a thickness of 75 micrometers and a width of 88 centimeters was unrolled and transported past a preliminary cleaning station containing an air knife and a vacuum nozzle which removed dirt particles having an average size of at least 100 micrometers. It is believed that some dirt particles having an average size as low as 30 micrometers may also have been removed by the preliminary cleaning station. The web was then transported through a substantially "S" shaped path comprising a clockwise curve joined at one end with an end of a counterclockwise curve. Two contact cleaning rolls of a first turret containing three contact cleaning rolls were maintained in rolling contact with one of the two major web surfaces along the inside of the clockwise curve and two contact cleaning rolls of a second turret containing three contact cleaning rolls were maintained in rolling contact with the other of the major web surfaces along the inside of the clockwise curve. The web path and arrangement of the two contact cleaning roll turrets is similar to that shown in FIG. 4. The length of each contact cleaning roll was equal to 40 inches and the diameter of each contact cleaning roll was 12 centimeters. Each contact cleaning roll comprised a metal core around which was molded a polyurethane rubber layer having a thickness of 13 millimeters. The polyurethane rubber layer was a low tack rubbery cross-linked polyurethane material having a durometer of about 22 Shore A and is available from R. G. Egan, Rochester, N.Y. The speed of the web and the contacting surface of the contact cleaning rolls were synchronized to avoid slippage between the web and the contacting surface of the contact cleaning rolls. The rate of travel of the web was maintained at 21 meters (70 feet) per minute by controlling the rate of rotation of pull rolls positioned at the downstream end of the web. Examination of the surfaces of the contact cleaning rolls after rolling contact with 2,134 linear meters of each major web surface revealed dirt particles having an average particle size greater than 0.5 micrometer and less than 100 micrometers.

EXAMPLE II

The metalized web cleaned as described in Example I was coated with a solution of hydrolyzed aminosiloxane charge blocking material applied by a gravure applicator and dried in an oven drier to form a charge blocking layer having a thickness of 0.05 micrometers. This coated and dried web was then cleaned in a manner substantially identical to the procedures described in Example I. Examination of the coating layer cleaned by the cleaning rolls revealed no undesirable detachment of coating material from the underling surface.

EXAMPLE III

The web coated and cleaned as described in Example II was coated with a solution of a polyester applied by a gravure applicator and dried in an oven drier to form an adhesive layer having a thickness of 0.08 micrometer. This coated and dried web was then cleaned in a manner substantially identical to the procedures described in Example I and rolled up into a take-up roll. Examination of the coating layer cleaned by the cleaning rolls revealed no undesirable detachment of coating material from the underling surface.

EXAMPLE IV

The take-up roll described in Example III was moved to another station where it became the supply roll for additional cleaning and coating treatments. As the supply roll, the coated web was given a preliminary cleaning treatment with an air knife/vacuum system and thereafter cleaned on both major surfaces with contact cleaning rolls as described in Example I. The cleaned web was then extrusion coated with a solution of film forming polyvinyl carbazole containing a dispersion of inorganic photoconductive particles and dried in an oven drier to form a charge generating layer having a thickness of 1.6 micrometers. This coated and dried web was then cleaned in a manner substantially identical to the procedures described in Example I. Examination of the coating layer cleaned by the cleaning rolls revealed no undesirable detachment of coating material from the underling surface.

EXAMPLE V

The web coated and cleaned as described in Example IV was coated with a solution of a polycarbonate and arylamine charge transport material applied by extrusion coating and dried in an oven drier to form a charge transport layer having a thickness of 29 micrometers. This coated and dried web was then cleaned in a manner substantially identical to the procedures described in Example I and roiled up into a take-up roll. Examination of the coating layer cleaned by the cleaning rolls revealed no undesirable detachment of coating material from the underlying surface.

EXAMPLE VI

The procedures described in Examples I through V were repeated with the same materials except that transport of the web during coating was stopped and stationary contact cleaning rolls with the web was maintained for 8 hours. It was discovered that adhesion between the coating on the stationary web and the contact cleaning roll had increased so much during the period when the coating line was stopped that that the pull rolls could not move the web when startup was begun. The web had to be manually peeled away from the cleaning rolls to release the tension and start the line moving.

EXAMPLE VII

The procedures described in Examples I through VI were repeated with the same materials except that transport of the web during coating was stopped and the contact cleaning rolls were rocked back and forth during the period of web transport stoppage. The amount of rocking in one direction rotated the contact cleaner rolls sufficiently to bring a fresh area of the cleaner rolls into contact with the web and to separate from the web those areas of the cleaner rolls that were previously in contact with the web immediately following web transport stoppage. The time period between the point when web transport stoppage occurred and rocking of the cleaner rolls was initiated was less than 1 minute. Similarly, the time period between termination of rocking of the cleaner rolls in one direction and initiation of rocking of the cleaners rolls in the opposite direction was less than 5 seconds. Essentially, there was immediate initiation of rocking after the web transport was stopped and immediate termination of rocking when a web transport start signal was generated and the turret was returned to its home position. It was discovered that due to the imparting of the rocking action to the cleaner rolls, adhesion between the coating on the stationary web and the contact cleaning roll remained low enough to allow the pull rolls to move the web when startup was begun.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A contact cleaner roll cleaning system comprising:

a frame;

a movable web having a first major surface and a second major surface on opposite sides of the web;

at least a first rotatable contact cleaner roll supported on the frame disposed for rolling contact with the first major surface of the web, the first rotatable contact cleaner roll having a tacky outer surface;

an activatable web transporting device supported by the frame relative to the movable web, the activatable web transporting device adapted to transport and interrupt transport of the web past the first rotatable contact cleaner roll; and a first indexing device adapted to bring the tacky outer surface of the first rotatable contact cleaner roll into rolling contact against the first major surface of the web in a first direction while transport of the web is interrupted by the web transporting device, wherein the first rotatable contact cleaner roll is supported on the frame by a pivotable pair of parallel arms.

2. A system according to claim 1, wherein the first contact cleaning roll is carried at one end of the pivotable pair of parallel arms.

3. A system according to claim 2, wherein the pivotable pair of parallel arms are pivotable at the end of the pair of parallel arms opposite the end carrying the contact cleaning roll.

4. A system according to claim 2, wherein a second contact cleaning roll is carried at the end of the pivotable pair of parallel arms opposite the end carrying the first contact cleaning roll and wherein the pair of parallel arms are pivotable at the center between the ends.

5. A contact cleaner roll cleaning system according to claim 1 wherein the first rotatable contact cleaner roll comprises an electrically conductive cylindrical core coated with a tacky contact cleaning material.

6. A contact cleaner roll cleaning system, including:

a frame;

a web having a first major surface and a second major surface on opposite sides of the web, the web comprising at least one coating and the first major surface comprising an outer surface of the coating;

a first contact cleaner roll turret on the frame; and a first roll cleaner on the frame, the first contact cleaner roll turret including a plurality of rotatable contact cleaner rolls supported on the first contact cleaner roll turret;

an active one of the contact cleaner rolls disposed for rolling contact with the first major surface of the web, and an idle one of the contact cleaner rolls disposed out of contact with the first major surface of the web and in operative engagement with drive means to maintain the rotational speed of the idle roll; the first contact cleaner roll turret being rotatable to sequentially place the contact cleaner rolls into and out of contact with the first major surface of said web; the first roll cleaner mounted adjacent to the idle contact cleaner roll for movement into and out of engagement therewith and lengthwise therealong; the first roll cleaner including an absorbent cleaning material for placement against the idle contact cleaner roll; a second contact cleaner roll turret on the frame adjacent to the first contact cleaner roll turret; and a second roll cleaner on the frame; the second contact cleaner roll turret including a plurality of rotatable contact cleaner rolls supported on the second contact cleaner roll turret; an active one of the contact cleaner rolls on the second contact cleaner roll turret disposed for rolling contact with the second major surface of said web, and an idle one of the contact cleaner rolls disposed out of contact with the second major surface of the web and in operative engagement with drive means to maintain the rotational speed of the idle roll; the second contact cleaner roll turret being rotatable to sequentially place the contact cleaner rolls into and out of contact with the second major surface of the web; the second roll cleaner mounted adjacent to the idle roll for movement into and out of engagement therewith and lengthwise therealong; the second roll cleaner including an absorbent cleaning material for placement against the idle roll; the first contact cleaner roll turret and the second contact cleaner roll turret being positioned on the frame to guide the web in a substantially "S" shaped path; an activatable web transporting device adapted to transport or interrupt said transport of the web past the first contact cleaner roll turret and the second contact cleaner roll turret; and a first indexing device adapted to roll the active contact cleaner against the first major surface in one direction and to thereafter roll the first rotatable contact cleaner roll against the first major surface in the opposite direction while the transport of the web past the first rotatable contact cleaner roll is interrupted.

* * * * *